US005209174A

United States Patent [19]

Hunt

[11] Patent Number: 5,209,174

[45] Date of Patent: May 11, 1993

[54] MAST CLIMBING APPARATUS FOR SAILBOATS

[76] Inventor: Milby N. Hunt, 19 Manor Way, Galveston, Tex. 77550-3218

[21] Appl. No.: 856,634

[22] Filed: Mar. 25, 1992

[51] Int. Cl.[5] ..... B63B 15/00

[52] U.S. Cl. ..... 114/93; 182/100; 182/135

[58] Field of Search ..... 114/90, 94; 182/95, 182/96, 100, 189, 156, 135; 294/25, 26

[56] References Cited

U.S. PATENT DOCUMENTS 3,955,645 5/1976 Dye ..... 182/135
4,258,828 3/1981 Evans ..... 182/100
4,577,726 3/1986 Wheeler ..... 182/100

*Primary Examiner*—Jesus D. Sotelo
*Attorney, Agent, or Firm*—Browning, Bushman, Anderson & Brookhart

[57] ABSTRACT

A mast-climbing assembly for enabling a person to climb a mast includes a pair of step-leg units, a plurality of hook brackets each securable to the mast, and a pair of hand hangers. Each of the step-leg units includes a step member and a leg member that engage a foot and leg, respectively, of the climber. The assembly of the present invention allows a person to easily and safely climb a mast of a sailboat or other elongate vertical member.

20 Claims, 3 Drawing Sheets

MAST CLIMBING APPARATUS FOR SAILBOATS

BACKGROUND OF THE INVENTION

For all of the years that sailing ships and boats have been sailing the seas, there has always been a need for climbing the masts of such vessels. In early times the large ships had ratlines for climbing up on the rigging to reach the top of the mast. A sailor of smaller vessels was typically hauled up the mast by a borun's chair, which required at least one other person.

In more recent years, step devices have been used to climb a sailboat mast. These steps are typically made of aluminum, come in a variety of styles, and are permanently attached to the mast. The steps are arranged on the mast in coordinating left/right fashion so that a sailor can climb to the top of the mast. Some of the step devices fold up onto the sides of the mast when not in use. An article entitled "Stairway to Heaven" illustrates and describes steps that are currently in use today.

SUMMARY OF THE INVENTION

The present invention is directed to an improved step-type assembly for mast climbing. This improved step assembly offers at least nine assets that improve the existing mast steps that are currently marketed: (a) a full step for foot support, (b) a non-slip step, (c) minimal resistance to the wind, (d) minimal weight added to the mast, (e) aesthetically pleasing design for a fixed step, (f) assembly components that do not chafe or snag the sail or the sail lines, (g) assembly components that are rattle proof, (h) assembly components that have improved safety compared to existing step devices, and (i) assembly components that are less expensive than many existing devices.

The step assembly comprises a pair of step leg units, a plurality of hook brackets, and a pair of hand hangers. These components allow a person to easily and safely climb a boat's mast, or any other type of elongate vertical member. The assembly may be referred to as a mast climber, and has significant advantages over prior art fixed step devices.

According to the method of this invention, a person wanting to climb a mast attaches a step leg unit to each foot and leg by stepping on a step member and by strapping a leg member of the unit to his lower leg by a leg strap attached to the upper portion of the leg member. The person then straps his foot to the step member by using a long foot strap, which is attached to the underside of the step member and passes over the instep of the person's foot. The foot strap passes through slots in the leg member to snugly fasten the foot strap and secure the step member to the person's foot. By passing the strap through slots in the step member and in the leg member according to a predetermined pattern, each foot member and leg member may be adequately secured with a snug fit to the person's foot and leg.

The plurality of hook brackets replace the fixed steps that are commonly used in the prior art. These hook brackets are permanently attached to the mast. A cringle, which is integral with each step leg unit, is the weight-carrying element of this assembly. Each cringle engages a hook member of the hook bracket, and is safely secured thereto by cuts or grooves in the bracket member. The climber may tie each of the pair of hand hangers to each other with a cord, which is passed under a belt at the climber's back in order to safeguard against accidental loss of one or both of the hand hangers. The person climbs the mast in coordinating left/-right fashion using the combined apparatus of the assembly, i.e., the step leg units, the hook brackets, and the hand hangers. These components may be easily used in complete harmony and safety to climb a mast.

DETAILED DESCRIPTION OF A PREFERRED EMBODIMENT

Figure 1:
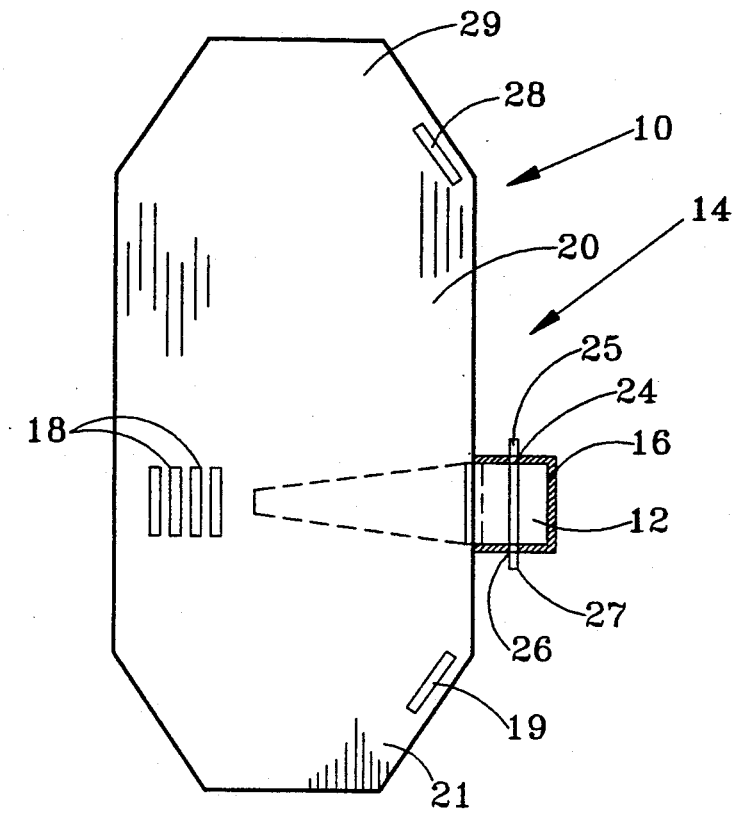
FIG. 1 is a top view of a step member for a step leg unit according to this invention, illustrating the overall design of the step member and the location of the strap slots.
Figure 7:
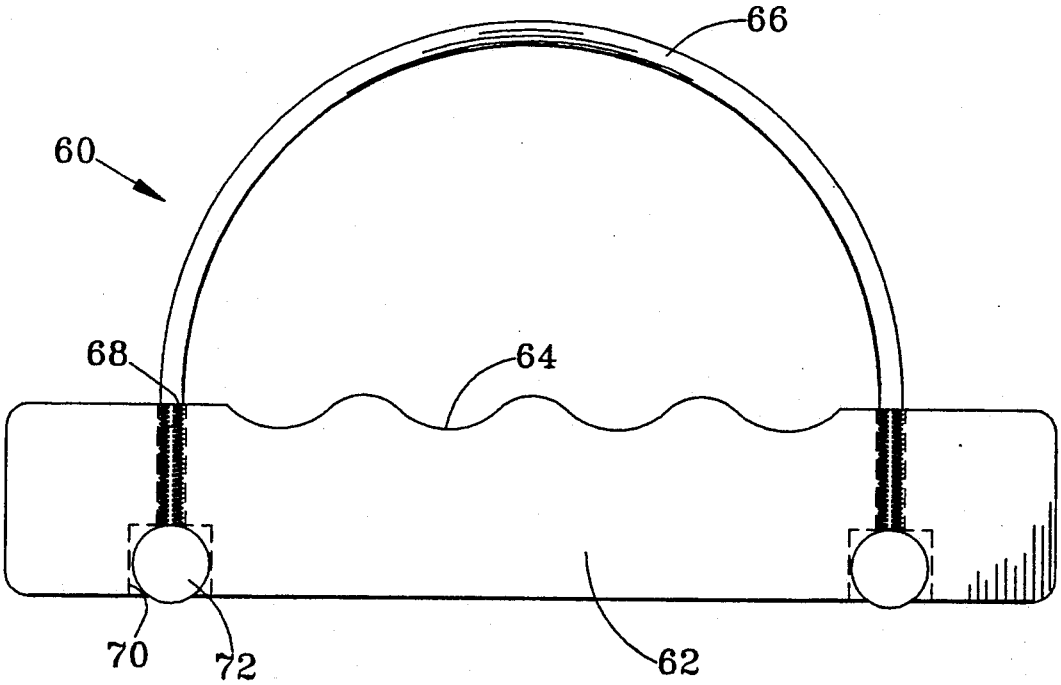
FIG. 7 is a front view of the hand hangers according to this invention.

FIG. 1 depicts a step member 10 and a portion of a leg member 12 that comprise a suitable step leg unit 14 according to this invention. The position of a cringle 16 with respect to the leg member 12 is depicted, and the hinge for bringing the step member and leg member together for storage is shown in dashed lines in the step member collapsed position. A suitable step member 10 may have a length of about 10" and a width of about 5½". A plurality of step strap slots 18 is depicted in plate 20 of the step member 10. These slots 18 are used by the climber to strap the step member 10 to his or her foot by the use of the foot strap 22 (see FIG. 2). Strap 22 is attached to the underside of the plate 20, and is passed up through the strap slot 18 that is closest to the foot (or literally, the shoe or boot). The strap 22 is led over the instep of the climber's foot, and then is passed through the strap slot 24 on the forward side 25 of the leg member 12. The strap 22 is then led through the opposing strap slot 26 on the rear side 27 of the leg member, passed around the heel of the climber's foot, and brought forward to and drawn through the step strap slot 28 on the forward side 29 of the plate 20. The strap 22 is rounted under the strap member 10 to the outside set of slots 18, passed up through a slot 18, passed behind the foot, and then passed down through the slot 19 at the heel end 21 of the plate 20. Any remaining length of said strap 22 can be secured by hook-and-eye strips, a clamp, or by other conventional securing means.

Figure 2:
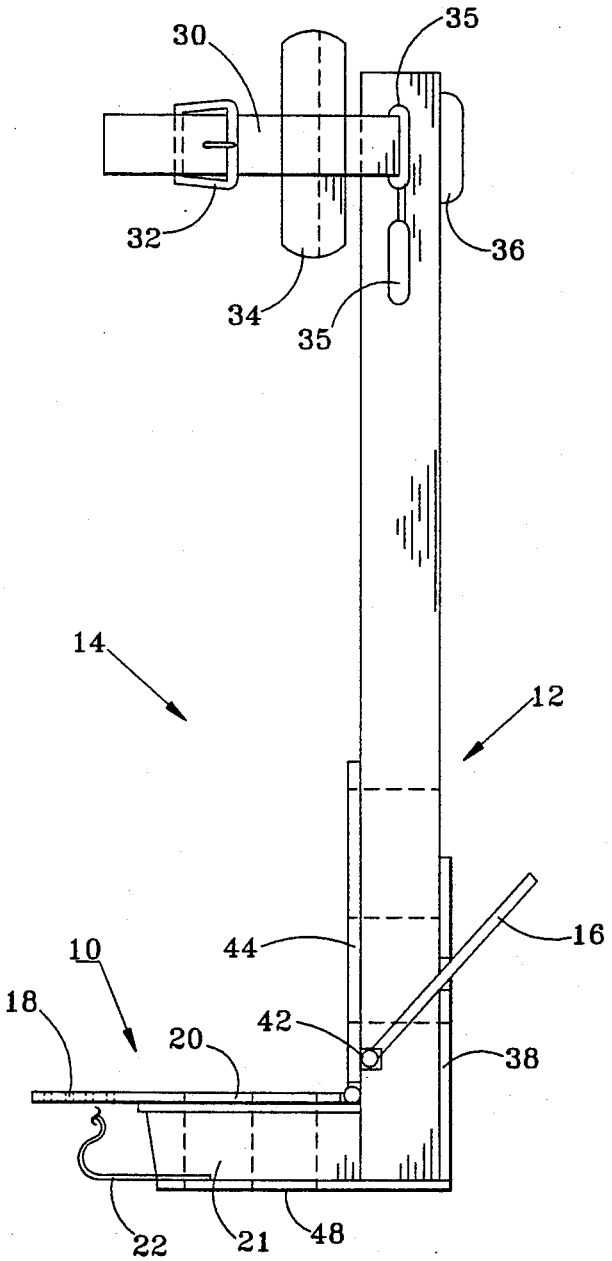
FIG. 2 is a side view of a left step-leg unit, illustrating the step member and the leg member attached together by the hinge, a channel cut across the inside of the leg member, and a cringle seated and locked in place within the channel. A strap with a buckle is shown at the top portion of the leg member, and a pad on the strap and a buffer pad on the opposing mast side of the leg member are also shown.

FIG. 2 illustrates leg strap 30, buckle 32, and pad 34. The climber, after strapping his foot onto the step member with the strap 22, may attach the strap 30 with buckle 32 to his leg to fit in the calf area of his leg, using the pad 34 on strap 30. The leg strap 30 is passed through a selected one of the leg slots 35. A buffer pad 36 is located on the side of leg member 12 that is opposite the mast of the boat or other mast.

The cringle 16 is shown in its stationary position in FIG. 2 after being rotated onto a leg plate 38 through the cutout 40 and seated in the cringle cut 42 in leg member 12. When this is done, the hinge 44 is through-bolted with screws (not shown) passing through the hinge 44, the leg member 12, and the leg plate 38. There are preferably at least three screws with nuts that secure these parts together.

Block 21 is shown in FIG. 2 for providing support for the step plate 20. Foot strap 22 is attached to the underside of block 21, and a foot pad 48 is glued to the bottom of block 21.

Figure 3:
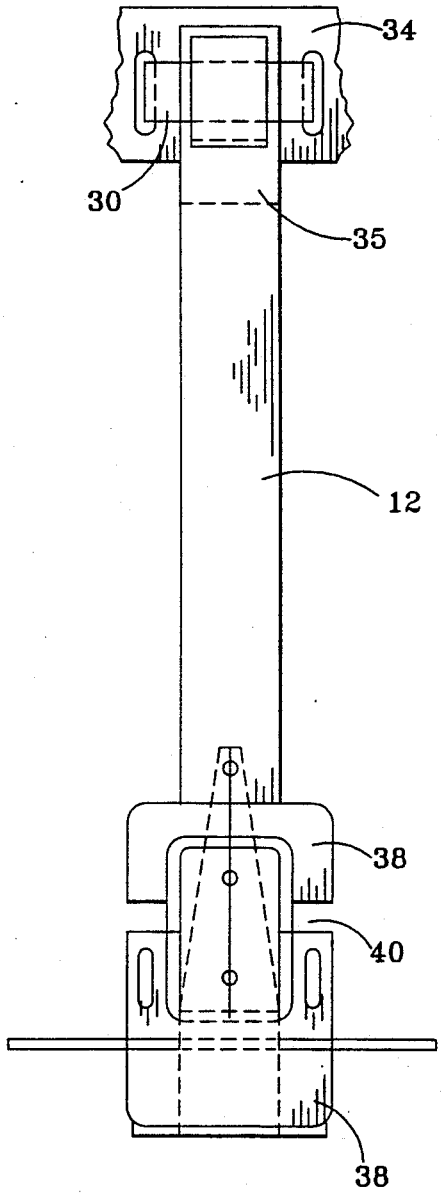
FIG. 3 is a front view of the step leg unit, with a portion of the step member removed for clarity to illustrate a leg plate with a cutout for the insertion of the cringle and the leg strap slots.

FIG. 3 shows a front view of the leg member 12 and the relationship of the components. The cringle 16 is fixed to the leg member 12 at an angle of approximately 30° from vertical. This allows for a primarily downward pull on the hook of the hook bracket, and allows for less stress on the cringle 16. The alignment of the cringle is maintained by the cut or channel in the leg member 12. To maintain the desired angle, the position of the leg plate 38 is also fixed, e.g., by bolts (not shown) passing through the leg member 12.

Figure 4:
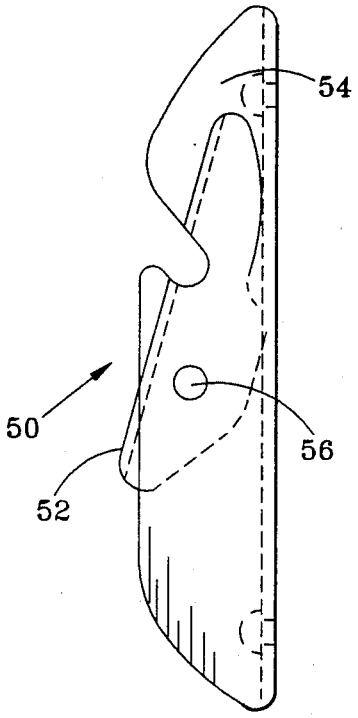
FIG. 4 is a side view of a hook bracket according to this invention, illustrating a pin in proper location with respect to the hook member and the bracket member. This view shows the hook member in a closed position.
Figure 5:
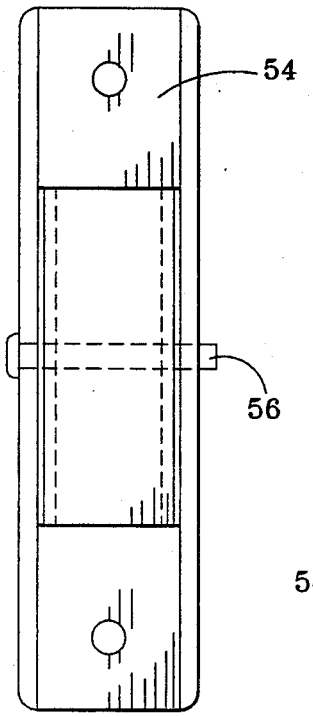
FIG. 5 is a front view of the hook bracket, showing the pin position with respect to the channels.
Figure 6:
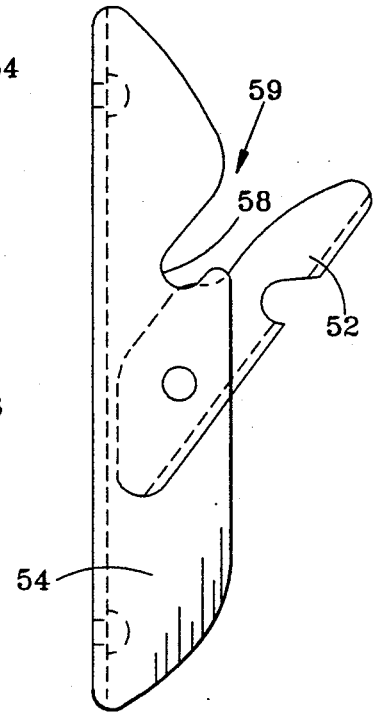
FIG. 6 is a left side view of the hook bracket in the open position.
Figure 5A:
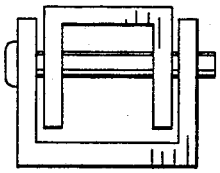
FIG. 5A is an end view of the hook bracket shown in FIG. 5.

FIGS. 4, 5 and 6 depict the hook 52 and the bracket 54, which together form the assembly 50. Each of the hook and bracket may be from stainless steel, with the hook 52 having channel or U-shaped cross-sectional configuration smaller than the bracket 54. The hook 52 and bracket 54 are connected together with a pin 56 that acts as a pivot for the opening and the closing of the hook 52. The bracket 54 is attached to and secured onto the mast by any suitable means, such as bolts. FIG. 4 shows the hook 52 in the closed position. To move the hook 52 to the open position, as shown in FIG. 6, the climber pushes the bottom of the hook toward the mast. The hook then rotates to the open position as shown in FIG. 6, which is its working position to accept the cringle 16 into the grooved cutout 58 within the bracket 52. In its open position, the hook member 52 forms a throat area 59 with the bracket member 54 that extends to and terminates at the slot 58. The hook member thus prevents the cringle and the hand hanger discussed subsequently for inadvertently disengaging from the bracket 54 by slipping out of the slot 58. The bracket pin 56 preferably is 3/16" stainless steel pin, and may be secured in place by a cotter key. Pin 56 has a head portion on one end thereof.

The hand-hanger 60 is made in pairs, one for each hand. The handle 62 may be made of hard wood and has finger grooves 64 cut therein. A plastic-sheathed stainless steel cable 66 is looped about the handle, and a space approximately 2" above the finger grooves 64 is formed to receive the fingers (and optionally the glove) of the climber. The climber uses the cable 66 to catch the hook 52. Holes 68 are drilled close to the ends of the handle 62 and are enlarged on the bottom of each handle 62 to form a pocket 70 to receive swaged balls 72 that seat in the pockets. The balls 72 are swaged onto a cable 66 that is passed through the holes 68 in the handle and then swaged onto said cable. This becomes the hand hanger 60 that is used by the climber in conjunction with the hook and bracket assembly 50. The handles 62 are configured for a normal hand size.

What is claimed is:

1. A mast climbing assembly for enabling a person to climb a mast, comprising:

a pair of step leg units, each step leg unit including a step member having a substantially horizontal surface for supporting the person's foot, a leg member secured to the step member supporting the person's leg and a cringle secured to the leg member;

a plurality of hook brackets each securable to the mast at selected spacings along a length of the mast, each hook bracket including a slot therein for receiving a portion of the cringle to support a respective step leg unit from the hook bracket; and a pair of hand hangers, each hand hanger adapted for engagement with the person's hand, and including a securing member for positioning within the slot of a respective hook bracket to support the hand hanger from the hook bracket.

2. The mast climbing assembly as defined in claim 1, further comprising:

a leg strap for securing each of the pair of leg members to the person's leg.

3. The mast climbing assembly as defined in claim 1, further comprising:

a foot strap for securing each of the pair of foot members to the person's foot.

4. The mast climbing assembly as defined in claim 3, wherein each of the pair of step members includes a plurality of slots for receiving the foot strap.

5. The mast climbing assembly as defined in claim 1, wherein the cringle extends outwardly from the respective leg member in a direction opposite the step member.

6. The mast climbing apparatus as defined in claim 5, wherein each cringle is secured to a respective step member at an angle of approximately 30° relative to the vertical.

7. The mast climbing assembly as defined in claim 1, further comprising:

a hinge member for pivotally connecting the step member to the leg member.

8. The mast climbing apparatus as defined in claim 1, wherein each of the plurality of hook brackets includes a bracket member securable to the mast and having the slot therein, and a hook member pivotably connected to the bracket member.

9. The mast-climbing apparatus as defined in claim 8, wherein the hook member forms a throat area with the bracket member when pivoted to an open position, the throat area extending to the slot, and the hook member preventing the cringle from inadvertently disengaging from the hook bracket.

10. The mast climbing apparatus as defined in claim 1, wherein each of the hand hangers further comprises:

a handle member for gripping engagement by the person's hand; and a generally C-shaped cable member secured to the handle member and having a cross-sectional area to be received within the slot in the respective hook bracket.

11. A mast climbing assembly for enabling a person to climb a mast, comprising:

a pair of step leg units, each step leg unit including a step member for supporting the person's foot, a foot securing member for securing each of the pair of foot members to the person's foot, a leg member secured to the step member, a leg securing member for securing each of the pair of leg members to the person's leg, and a cringle secured to the leg member;

a plurality of hook brackets each securable to the mast at selected spacings along a length of the mast, each hook bracket including a slot therein for receiving a portion of the cringle to support a respective step leg unit from the hook bracket; and a pair of hand hangers, each hand hanger adapted for engagement with the person's hand, and including a securing member for positioning within the slot of a respective hook bracket to support the hand hanger from the hook bracket.

12. The mast climbing assembly as defined in claim 11, wherein the cringle extends outwardly from the respective leg member in a direction opposite the step member.

13. The mast climbing apparatus as defined in claim 11, wherein each of the plurality of hook brackets includes a bracket member securable to the mast, and having the slot therein, and a hook member pivotably connected to the bracket member.

14. The mast climbing apparatus as defined in claim 11, wherein each of the hand hangers further comprises:

a handle member for gripping engagement by the person's hand; and a generally C-shaped cable member secured to the handle member and having a cross-sectional area to be received within the slot in the respective hook bracket.

15. A mast climbing assembly for enabling a person to climb a mast, comprising:

a pair of step leg units, each step leg unit including a step member for supporting the person's foot, a leg member secured to the step member, and a cringle secured to the leg member and extending outwardly therefrom in a direction opposite the step member;

a plurality of hook brackets each securable to the mast at selected spacings along a length of the mast, each hook bracket including a slot therein for receiving a portion of the cringle to support a respective step leg unit from the hook bracket; and a pair of hand hangers, each hand hanger adapted for engagement with the person's hand, and including a securing member for positioning within the slot of a respective hook bracket to support the hand hanger from the hook bracket.

16. The mast climbing assembly as defined in claim 15, further comprising:

a leg strap for securing each of the pair of leg members to the person's leg.

17. The mast climbing assembly as defined in claim 16, wherein each of the pair of step members includes a plurality of slots for receiving the foot strap.

18. The mast climbing apparatus as defined in claim 15, wherein each of the plurality of hook brackets includes a bracket member securable to the mast and having the slot therein, and a hook member pivotably connected to the bracket member.

19. The mast climbing apparatus as defined in claim 18, wherein the hook member forms a throat area with the bracket member when pivoted to an open position, the throat area extending to the slot, and the hook member preventing the cringle from inadvertently disengaging from the hook bracket.

20. The mast climbing apparatus as defined in claim 15, wherein each of the hand hangers further comprises:

a handle member for gripping engagement by the person's hand; and a generally C-shaped cable member secured to the handle member and having a cross-sectional area to be received within the slot in the respective hook bracket.

* * * * *